United States Patent [19]

Sundberg

[11] Patent Number: 4,529,361

[45] Date of Patent: Jul. 16, 1985

[54] VANE PUMP HAVING SPOKES WITH CHANNEL-SHAPED VANES

[75] Inventor: Jack G. Sundberg, Meriden, Conn.

[73] Assignee: Chandler Evans Inc., West Hartford, Conn.

[21] Appl. No.: 600,149

[22] Filed: Apr. 13, 1984

[51] Int. Cl.[3] ..... F04B 23/12

[52] U.S. Cl. ..... 417/204; 418/268

[58] Field of Search ..... 417/204, 286; 418/268; 91/490

[56] References Cited

U.S. PATENT DOCUMENTS

| | | | |
|---|---|---|---|
| 741,053 | 10/1903 | Mattill | 418/268 |
| 2,174,664 | 10/1969 | Korany | 418/268 |
| 3,009,420 | 7/1957 | Livermore et al. | 418/268 |
| 3,081,706 | 3/1963 | Drutchas et al. | 417/204 |
| 3,102,493 | 9/1963 | Davin | 418/268 |
| 3,431,861 | 3/1969 | Martin | 418/268 |
| 3,936,246 | 2/1976 | Beitzel | 417/204 |

*Primary Examiner*—Cornelius J. Husar
*Assistant Examiner*—Peter M. Cuomo
*Attorney, Agent, or Firm*—Radford W. Luther; Richard A. Dornon

[57] ABSTRACT

A vane pump (2), with undervane pumping capability, has a housing (4,14) within which a cam ring (16) is mounted. The cam ring has a cam surface which defines a pumping cavity and which includes two diametrically opposed inlet arcs (48, 50), two diametrically opposed discharge arcs (38, 40) and seal arcs (56, 58, 60, 62) disposed between the inlet arcs and discharge arcs. A rotor (12), mounted for rotation within the housing, carries a plurality of spokes (22). Mounted upon the spokes for radially outward and inward movement are channel-shaped vanes (28) having arcuate tips (46) for engaging the cam surface. Variable volume chambers (94), which provide undervane pumping, are formed between the radially outer ends of the spokes and the vanes. The variable volume chambers communicate with intervane volumes (93) through grooves (86) on the spokes. The vane tips engage seal arcs along a line of contact (76) selected to insure that the vanes are pressure balanced.

3 Claims, 4 Drawing Figures

VANE PUMP HAVING SPOKES WITH CHANNEL-SHAPED VANES

TECHNICAL FIELD

This invention relates to vane pumps and more particularly to vane pumps having pressure balanced vanes and undervane pumping.

BACKGROUND ART

Vane pumps required to operate at high speeds and pressures may employ hydrostatically (pressure) balanced vanes for maintaining vane contact with the cam surface in seal arcs and minimizing frictional wear. Such pumps may also include a rounded vane tip to reduce vane to cam surface hertzian stresses. Examples of vane pumps having pressure balanced vanes which are also adapted to provide undervane pumping, may be found in U.S. Pat. Nos. 3,711,227 and 4,354,809. In the aforementioned patents, the vanes are slideable within slots machined in a rotor.

DISCLOSURE OF THE INVENTION

In a vane pump of the invention, the rotor embodies a plurality of spokes which respectively carry U-shaped vanes at their ends mounted for radial sliding movement thereover. The spoke and U-shaped or channel shaped vane arrangement allows for undervane pumping and facilitates the pressure balancing of the vanes in seal arcs.

A pump of the invention is advantageous in a number of respects. Because of the relatively large volume formed between the interior of the U-shaped vane and the end of the spoke, substantial undervane pumping capacity may be incorporated in a pump of the invention without an unacceptable increase in vane weight. Undervane pumping is, of course, a highly desirable attribute of a vane pump because it permits beneficial reductions in pump length and/or vane stroke. Also, the shape of the vanes render it possible to employ vane tips having a large radius of curvature whereby vane to track stress may be ameliorated in addition to the previously mentioned facilitation of pressure balancing.

Accordingly, it is a primary object of the invention to provide a vane pump with undervane pumping having a rotor with spokes and channel-shaped vanes mounted on the ends thereof for radial sliding movement thereover.

This and other objects and advantages of the invention will become more readily apparent from the following detailed description, when taken in conjunction with the accompanying drawings, in which:

BEST MODE OF CARRYING OUT THE INVENTION

Figure 1:
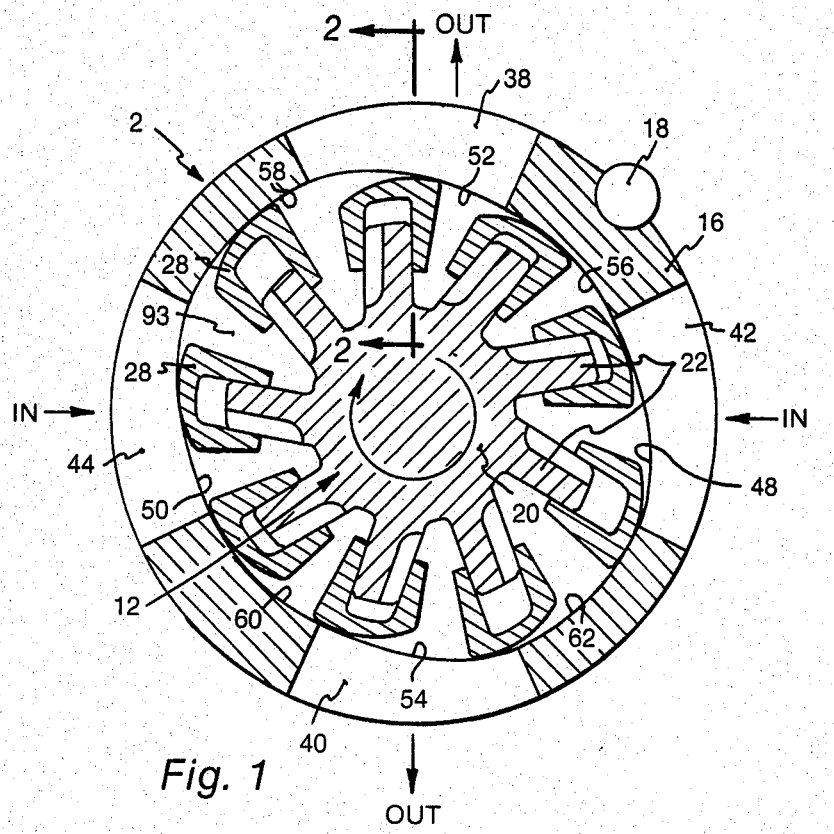
FIG. 1 is a fragmentary transverse sectional view of a vane pump according to the invention.
Figure 2:
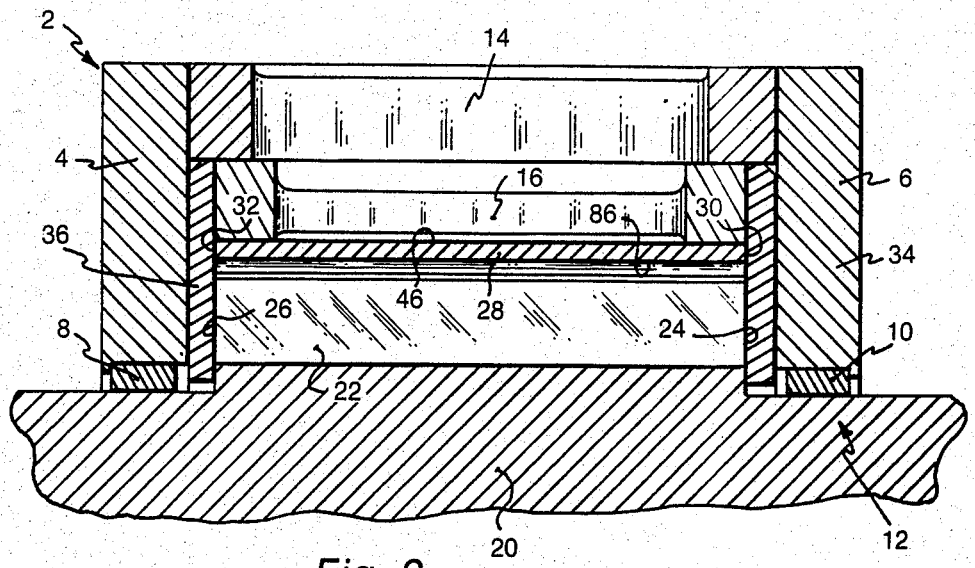
FIG. 2 is a fragmentary, longitudinal, sectional view of the pump of FIG. 1, taken substantially along the line 2—2 of FIG. 1.

Referring to the drawings, and more particularly to FIGS. 1 and 2, there is shown a vane pump of the invention illustrated generally at 2. The vane pump 2 has a conventional housing formed by various sections of which only two are depicted for the sake of simplicity. As best shown in FIG. 2, bearing housing elements 4 and 6 have bearings 8 and 10 for mounting and supporting a rotor 12 for rotation. A cam housing 14 is disposed between the bearing housing elements 4 and 6 in surrounding relationship to the usual cam ring 16 which could be of one piece or multiple piece construction and which is maintained in proper angular orientation with respect thereto by a locator pin 18, as shown in FIG. 1. The cam ring 16 has side faces which lie in planes perpendicular to the axis of the rotor.

Figure 3:
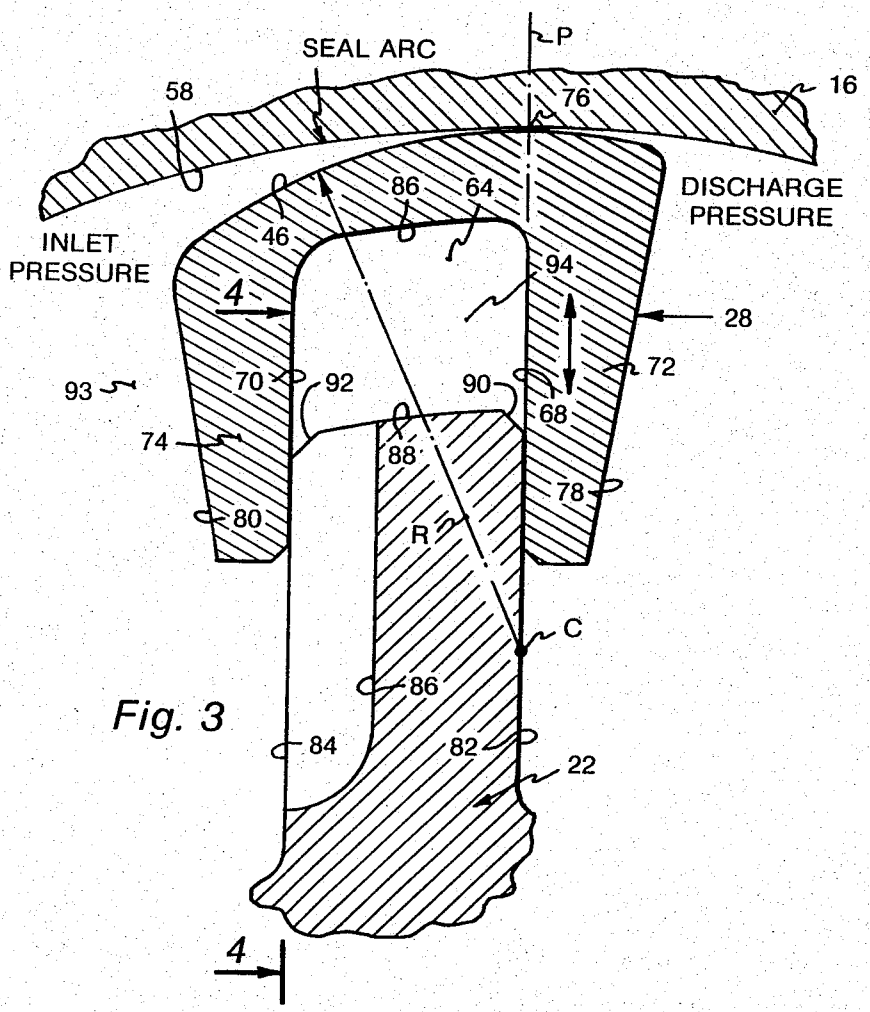
FIG. 3 is an enlarged view of a portion of the vane pump of FIG. 1 showing a vane in a sealing arc of the cam surface.

As best shown in FIGS. 1 and 2 the rotor 12 has a highly unusual configuration. The rotor 12 is an elongated cylindrical body 20 which carries a plurality of equally spaced spokes 22 radiating from the outer periphery of an inboard segment of the cylindrical body 20. The right and left side faces 24 and 26 of the spokes lie in respective planes perpendicular to the axis of the rotor. As shown in FIGS. 1 and 3 the rotor is adapted to rotate in the clockwise direction as indicated by the arrow.

A plurality of U-shaped or channel shaped vanes 28 are respectively mounted for radial inward and outward sliding movement upon the spokes 22. The vanes 28 are equal in length to the spokes whereby their right and left side faces 30 and 32 respectively lie in the same planes as the side faces 24 and 26 of the spokes 22 and the cam ring 16. Side plates 34 and 36, which may be pressure loaded, are respectively disposed between the bearing housing sections 4 and 6 and the flush side faces of the cam ring 16, the vanes 28 and the spokes 22 to seal the pumping cavity and enhance pumping efficiency in the customary manner.

With reference to FIG. 1, it will be seen that the cam ring 16 is provided with two diametrically opposed radial discharge ports 38 and 40 and two radial inlet ports 42 and 44. The inlet and discharge ports form diametrically opposed pairs to thereby pressure balance the rotor 12. The interior periphery of the cam ring 16, which defines a pumping cavity, constitutes a highly polished cam surface over which the tips 46 of the vanes may travel. As best shown in FIG. 1, the cam surface is formed by two inlet arcs 48 and 50 of progressively increasing distance from the rotor axis and two discharge arcs 52 and 54 of progressively decreasing distance from the rotor axis. Seal arcs 56, 58, 60 and 62 (which are of arcs of circles and greater in length than the spacing between the lines of contact of two adjacent vanes on the cam surface) are interposed between the discharge arcs and seal arcs. Thus, it will be appreciated that the cam ring is of the type to be found in many prior art vane pumps.

Figure 4:
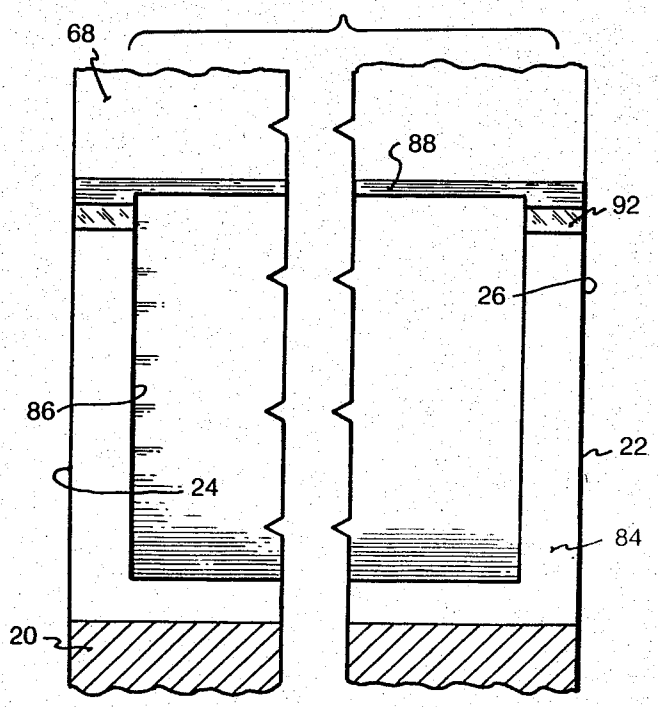
FIG. 4 is a view of a spoke on the rotor as it would appear along the line 4—4 of FIG. 3.

From FIGS. 3 and 4, the detailed construction of the channel-shaped vanes 28 and the spokes 22 may be best appreciated. Considering the geometry of a vane 28 first, it will be noted that the vane 28 has a channel 64 formed therein by a base 66 and inboard parallel sidewalls 68 and 70 of leg portions 72 and 74, respectively. The tip or upper surface 46 of the vane 28 has a line of contact 76 for engaging against the cam surface of the cam ring 16 in the seal arcs. The outboard sidewalls 78 and 80 of the leg portions 72 and 74 converge somewhat in a radially inward direction to furnish necessary clearance between adjacent vanes.

Each spoke 22 is generally rectangular in transverse cross section and has an advancing or leading sidewall 82 and a parallel trailing sidewall 84. The leading sidewall lies in a radial plane P which contains the rotor axis and the line 76. The trailing sidewall 84 of the spoke 22 is relieved to define a groove 86 which extends substantially the entire radial length of the spoke 22 and over a major portion of its width as can be seen in FIG. 4. The provision of the groove 86 on the spoke 22 is advantageous since it may readily be dimensioned to avoid any blockage by contaminants. It will be appreciated that the size of grooves in vanes or in rotors of prior art vane pumps does not render such pumps overly contaminant resistant. Moreover, the grooves 86 may easily be machined in the spokes 22. The end or upper surface 88 of the spoke 22 has contour which generally conforms to that of the base 66 of the channel 64 and has beveled edges 90 and 92. As shown in FIG. 3, there is a sliding fit between the spoke 22 and the channel 64 whereby the confronting sidewalls 82 and 68 and the confronting sidewalls 70 and 84 are in sliding engagement.

Seal arcs 58 and 62 are each arcs of a circle while seal arcs 56 and 60 are arcs of a circle of slightly less diameter. The centers of the aforementioned circles are at the axis of rotation of the rotor 12 in the particular pump illustrated. Preferably, tip 46 of the vane 28 as it appears in transverse cross section (FIG. 3) would also be a circular arc although it is not necessary to successful implementation of the invention as the utilization of other curves or even straight lines is permissible. As shown in FIG. 3, vane tip 46 is depicted as it would appear in a cutting plane perpendicular to the axis of rotor rotation and is the arc of a circle of radius R, the center of which lies in the radial plane P which contains the rotor axis and the line 76 as well as the leading sidewall 82. Since the vane tip 46 always engages a seal arc along the line 76, pressure balance in all seal arcs is achieved because the upward and downward pressure forces acting on the vane 28 to the right of the radial plane (e.g., discharge pressure) are equal and the upward and downward pressure forces acting on the vane 28 to the left of the radial plane (e.g., inlet pressure) are equal. In this latter respect, it will be noted that the pressure in an intervane volume 93 to the left of the line 76 (e.g., inlet pressure) is communicated to the channel 64 by the groove 86. Of course, pressure balance in discharge arcs and inlet arcs is present since all surfaces of a vane would be referenced to either discharge pressure or inlet pressure. Hence, in the illustrated preferred pump of the invention the only force urging the vane outwardly is centrifugal force in all cam surface locations.

Substantial undervane pumping in relationship to vane weight in a pump of the invention is possible because of the relatively large variable volume chamber 94 enclosed between the end 88 of the spoke 22, the base 66 of channel 64 and the inboard sidewalls 68 and 70 of the vane 28. When the vane 28 traverses an inlet arc and moves radially outwardly, chamber 94 expands, filling with fluid via the groove 86. Conversely, when the vane 28 traverses a discharge arc and moves radially inwardly, the chamber 94 contracts and fluid therein is displaced therefrom through the groove 86. In a seal arc, there is, of course, no radial movement of the vane 28.

During pumping, as the rotor 12 rotates, the vanes have their tips 46 in sliding engagement with the cam surface so as to move radially inwardly while traversing discharge arcs and move radially outwardly while traversing inlet arcs. When traversing a seal arc, a vane undergoes no radial displacement. Hence, fluid is expelled from an intervane volume over a discharge arc and enters an intervane volume over an inlet arc. The discharge flow will be supplemented by fluid simultaneously expelled to an intervane volume from the chambers 94 (through the respective grooves 86) during travel of an adjacent vane over a discharge arc since the volume of these chambers is progressively decreased during radially inward vane movement. The chambers 94 have their volumes progressively increased when an adjacent vane travels over an inlet arc and therefore receive fluid from an intervane volume via the respective grooves 86 during such vane travel. When a vane traverses a seal arc, the undervane chambers 94 are neither enlarged nor restricted since the vane maintains a constant radial position.

The invention is not limited to pumps embodying pressure balanced rotors wherein there are two diametrically opposed seal arcs and two diametrically opposed discharge arcs. It will be noted that the invention could readily be incorporated in pumps having only one discharge arc and one inlet arc with a seal arc therebetween. In such a case the vanes may, if desired, be hydraulically balanced in the seal arc as heretofore explained.

Moreover, the grooves 86 in the spokes could be readily replaced by grooves or passages in the vanes or other passage means in the spokes for establishing fluid communication between the chamber 94 and an intervane volume.

What is claimed is:

1. In a vane pump capable of undervane pumping of the type having:

a housing with a cam surface therein defining a pumping cavity, the cam surface including a discharge arc, an inlet arc and a seal arc therebetween; a rotor mounted for rotation in the pumping cavity about a longitudinal axis, the improvement comprising:

a plurality of spaced radially extending spokes carried by the rotor and radiating from the outer periphery thereof;

a plurality of channel-shaped vanes, having tips for engaging the cam surface, respectively mounted upon the spokes for radially inward and outward movement such that a plurality of variable volume chambers are respectively defined between the ends of the spokes and the vanes and variable intervane volumes are respectively defined between adjacent vanes; and means for establishing fluid communication between each variable volume chamber and an intervane volume adjacent thereto.

2. The improvement of claim 1, wherein each vane has a tip that is arcuate in transverse cross section and that has a fixed line of contact along which engagement is made with the seal arc and wherein each vane has two leg portions having inboard sidewalls and wherein each spoke has two radially extending parallel sidewalls for slidingly engaging the inboard sidewalls of the vane mounted thereupon and wherein a sidewall of each spoke lies in a radial plane containing the axis of rotation of the rotor and the line of contact of the vane mounted thereupon.

3. The improvement of claim 2, wherein the tip of each vane in transverse cross section comprises an arc of a circle having its center in the radial plane extending through the line of contact thereof.

* * * * *